US006981608B2

(12) United States Patent
Battmer

(10) Patent No.: US 6,981,608 B2
(45) Date of Patent: Jan. 3, 2006

(54) BEVERAGE CAN

(76) Inventor: C. Brady Battmer, 30A Wilkie Road, Singapore (SG), 228052

( * ) Notice: Subject to any disclaimer, the term of this patent is extended or adjusted under 35 U.S.C. 154(b) by 286 days.

(21) Appl. No.: 10/338,455

(22) Filed: Jan. 8, 2003

(65) Prior Publication Data

US 2004/0129704 A1 Jul. 8, 2004

(51) Int. Cl.
*B65D 17/34* (2006.01)

(52) U.S. Cl. ..... 220/269; 220/270; 220/661; 220/906

(58) Field of Classification Search ..... 220/269, 220/270, 661, 906
See application file for complete search history.

(56) References Cited

U.S. PATENT DOCUMENTS 4,213,538 A 7/1980 Boardman
5,011,037 A 4/1991 Moen
5,285,919 A 2/1994 Recchia
5,695,085 A 12/1997 Hadener
5,782,373 A * 7/1998 Bianchi
6,015,060 A 1/2000 Rightenour
6,250,491 B1 * 6/2001 Lee

* cited by examiner

*Primary Examiner*—John A. Ricci
(74) *Attorney, Agent, or Firm*—David E Herron, II

(57) ABSTRACT

A beverage can with a bottom end, a top end, and a side wall extending therebetween. A first weakening score is formed in the top end, and a second weakening score is formed near the bottom end of the can. The beverage can has a first tab selectively displaceable between an initial position wherein the first tab is generally parallel to the can a displaced position wherein the first end pierces the can by causing the first weakening score to fail, thereby forming a first opening. A second tab with features similar to the first tab is positioned near the second weakening score. Specifically, the second tab is selectively displaceable between an initial position wherein the second tab is generally parallel to the can, and a displaced position wherein the first end pierces the can by causing the second weakening score to fail, thereby forming a second opening. Beverage may exit the can from either the first or second opening.

19 Claims, 3 Drawing Sheets

BEVERAGE CAN

SUMMARY OF THE INVENTION

The invention is a beverage can, such as a generally-cylindrical aluminum soda can. The can has a bottom end, a top end, and a side wall extending therebetween. A generally round first weakening score is formed in the top end, and another is formed near the bottom end of the can. The beverage can will also have a first tab selectively displaceable between initial position wherein the first tab is generally parallel to the can a displaced position wherein the first end pierces the can by causing the first weakening score to fail, thereby forming a first opening.

The beverage can will also have a second tab with features similar to the first tab. Specifically, the second tab is selectively displaceable between an initial position wherein the second tab is generally parallel to the can, and a displaced position wherein the first end pierces the can by causing the second weakening score to fail, thereby forming a second opening. Beverage may exit the can from either the first or second opening.

Each of the first tab, the second tab, and the can will be configured to bear distinct respective longitudinal axes. A plane that contains the longitudinal axis of the can and the first tab will be generally orthogonal to the plane that contains the longitudinal axis of the can and the longitudinal axis of the second tab.

The second weakening score may be positioned either on the side wall adjacent the bottom end, and may intersect the bottom end itself. Additionally, the second weakening score may be positioned within a flattened area on the can.

The first tab may have a first end that extends over the first weakening score and a second end extending away from the first score with a fulcrum therebetween. Generally, the fulcrum should be attached to the can at a position displaced from the first score. Like the first tab, the second tab may also have a first end that extends over the second weakening score and a second end that extends away from the second score, and a fulcrum therebetween. Analogously, the fulcrum of the second tab is preferably attached to the can at a position displaced from the second score.

The can may also bear a depression formed on the can beneath the second end of either or both of the first and second tabs.

In another embodiment of the inventive beverage can, either or both of the first or second tabs may be removable from the can. In this embodiment, the respective tab is bound by the respective weakening score. In this embodiment of the invention, one causes the respective weakening score to fail by displacing the tab, starting at its second end, and pulling the tab from the can, thereby creating an opening.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
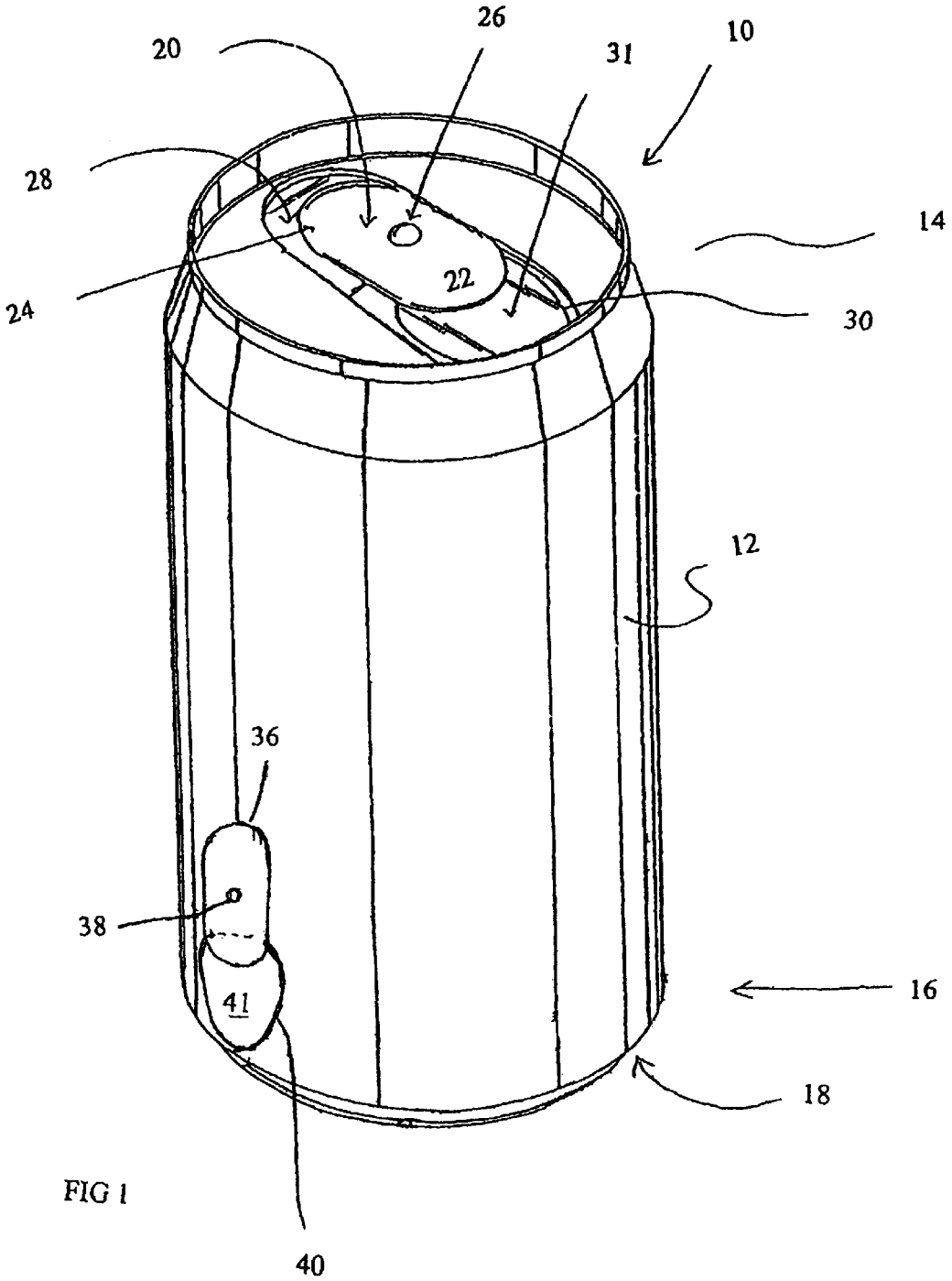
FIG. 1 is a perspective view of a first embodiment of the inventive beverage can, according to the principles of the invention.

FIG. 1 shows the beverage can 10 having a side wall 12 extending between a top end 14 and a bottom end 16. The can 10 includes a first tab 20 positioned at the top end 14, and a second tab 32 positioned near the bottom end 16.

Still referring to FIG. 1, the first tab 20 has a first end 22 and a second end 24 distal the first end, and a fulcrum 26 positioned between the ends 22,24. In this embodiment, the first tab 20 is selectively displaceable from an initial position (as shown in FIG. 1) wherein the tab 20 is generally parallel to the top 14 of the can 10, to a position wherein the second end 24 is raised, causing the tab 20 to pivot about its fulcrum 26, thereby forcing the first end 22 downwardly to engage the area 31 bound by the first weakening score 30. In this embodiment, the area 31 will remain attached to the can 10, even after the weakening score 30 fails.

As shown in FIG. 1, the first end 22 of the first tab 20 should extend over the weakening score 30. Thus, as the first end 22 is raised, the second end 22 causes the score 30 to fail, thereby creating a first opening in the can 10. The top 14 of the can 10 may also bear a depression 28 positioned beneath the second end 24 of the first tab 20. The depression 28 makes the beverage can 10 easier to open by allowing a small space for one to wedge a finger or other object between the tab 20 and the top 14 of the can 10.

Still referring to FIG. 1, the can 10 will also have a second tab 32 positioned near the bottom 16 of the can. In one embodiment (not shown) the second tab 32 is positioned on the base 18 of the can. In the embodiment shown in FIG. 1, however, the second tab 32 is positioned on the side wall 12 adjacent the base 18.

In the embodiment shown in FIG. 1, the second tab 32, in many ways, is similar to the first tab 20. Specifically, the second tab 32 has a first end 34 and a second end 36 and a fulcrum 38 therebetween. The first end 34 of the second tab 32 should extend over the area 41 bound by the second weakening score 40. In order to create a second opening, the second end 36 of the second tab 36 is raised from the can 10, thereby pivoting the tab 32 about fulcrum 38 and forcing the first end 34 to engage the area 41 bound by the second weakening score 40. As the second end 35 is raised, the first end 34 causes the weakening score 40 to fail, thereby creating a second opening near the bottom 16 of the can 10. In this embodiment, the area 41 within the weakening score 40 will remain attached to the can 10, even after the weakening score 40 fails.

Figure 2:
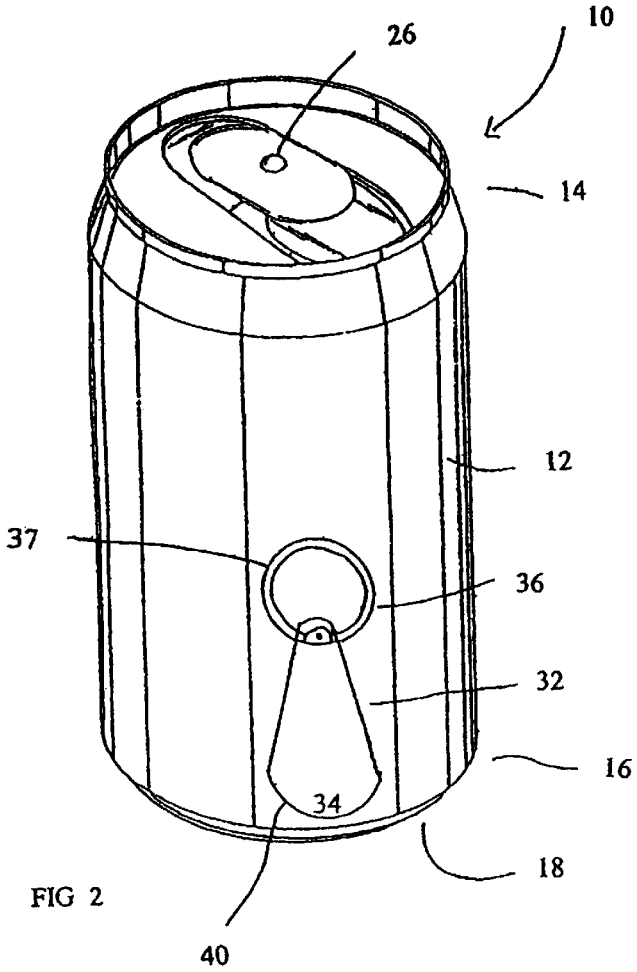
FIG. 2 is a perspective view of a second embodiment of the inventive beverage can, according to the principles of the invention.

FIG. 2 shows an alternate embodiment of the invention. For the purpose of clarity, analogous parts have been given identical reference numbers, even though the precise structure of the referenced part may differ.

Referring to FIG. 2, note that the structure of the top 14 of the can 10 is substantially identical to the top 14 that is shown in FIG. 1. In contrast, however, the second tab 32 positioned near the bottom 14 differs. In this embodiment, the second tab 32 is similar to a pull-type tab that is removable from the can. Specifically, the second tab 32 bears a first end 34 that is generally integral with the side wall 12 and is bound by the second weakening score 40. As in other embodiments, the second end 36 of the tab 32 is connected to the first end 34. As shown in FIG. 2, the second end 36 of the second tab 32 may include a ring 37.

Still referring to FIG. 2, the second tab 32 may be removed from the can 10 by displacing the first end 36 from the side wall 12, thereby causing the weakening score 40 to fail. One continues to displace the second end 36 until the weakening score 40 fails entirely. When this occurs, the entire second tab 36 is removed from the can, and a second opening is formed.

Of course, the pull-type tab arrangement, shown by the second tab 32 in FIG. 2, may also be used in place of the first tab 20. Thus, the pull-type tab (as shown in FIG. 2) and the punch-type tab (as shown in FIG. 1) are considered interchangeable. Other types of tabs may be used, such as an adhesive-type tab that covers a pre-formed opening in the can, provided the principles of the invention are not destroyed.

Each of the first tab, the second tab, and the can have distinct respective longitudinal axes. One plane will contain the longitudinal axis of the can and the longitudinal axis of the first tab. Another plane will contain the longitudinal axis of the can and the longitudinal axis of the second tab. It has been found that, in order to facilitate the easy opening of both tabs, these distinct planes should be generally orthogonal to one another.

Figure 3:
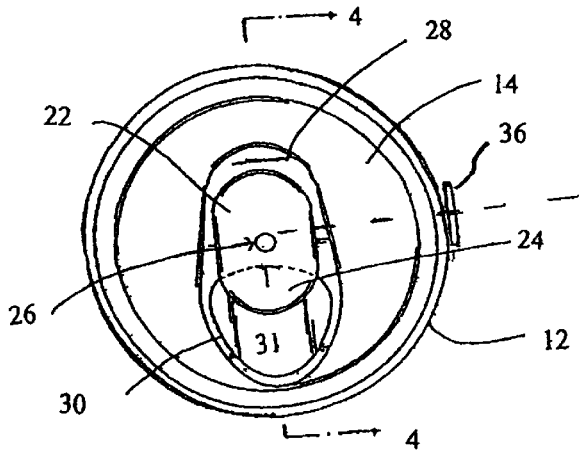
FIG. 3 is a plan view of the top of the beverage can.

FIG. 3 shows a plan view of the top 14 of the can. As shown, the can is generally cylindrical, and the top 14 is generally round. As shown in FIG. 3, the second end of the tab 28 is positioned over a depression 18 in the top 14. The first end 24 of the first tab 22 extends over the area 31 bound by the weakening score 30.

As shown in FIG. 3, the depression 28 should be positioned at least beneath the second end 22, but in fact the depression 28 may extend to include the entire tab 22 and the weakening score 31 as well.

Figure 4:
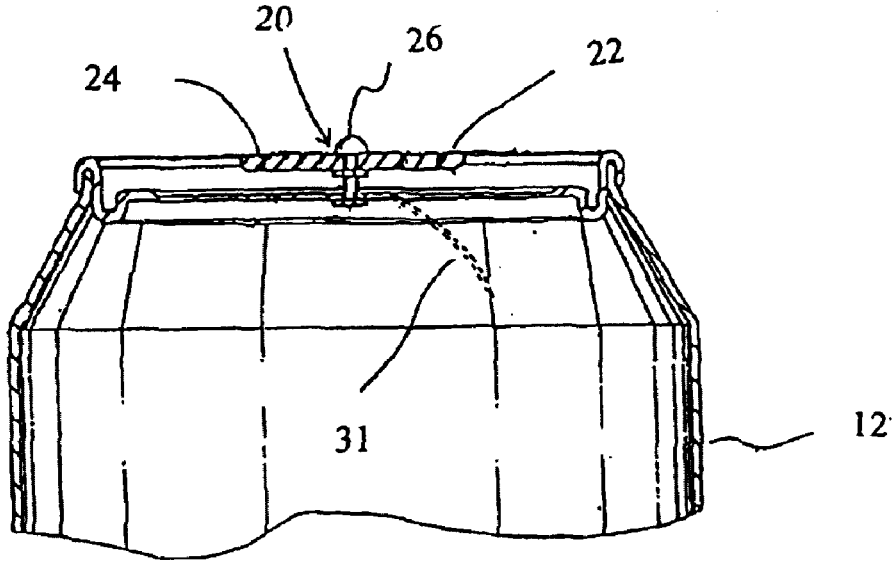
FIG. 4 is a cross-sectional view of the view of the beverage can.

FIG. 4 shows a cross-sectional view, as viewed from the plane as shown in FIG. 3. As shown in FIG. 4, the fulcrum 26 may include a spacer that slightly elevates the tab 20 from the top 14 of the can 10. The fulcrum 26 attaches to the can 10 at a location slightly displaced from the area 31. The area 31 bound by the weakening score (viewable in FIGS. 1–3, but not viewable in FIG. 4) is shown in a "punched in" position, wherein the first score has almost entirely failed, but a small portion of the score 30 remains intact, thereby retaining the area 31 in contact with the can 31, which may prevent accidental ingestion.

Figure 5:
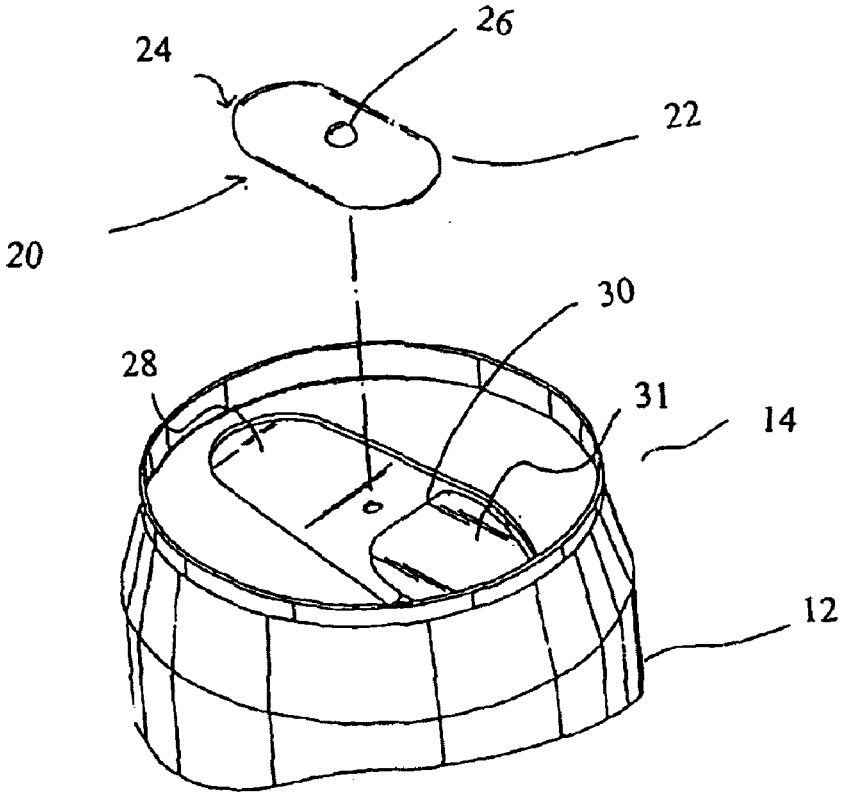
FIG. 5 is a perspective and exploded view of the top portion of the inventive beverage can.

FIG. 5 shows an exploded view of the top portion 14 of the can 10. For the ease of viewing, the first tab 20 is shown removed from the top 14. In this view, the fulcrum 26 is shown to attach the tab 20 to the can 10 at a location displaced from the weakening score 30.

Each of the embodiments show the top 14 to include a rim-like structure around its perimeter. This rim-like structure, while not mandatory or required, assists in protecting the tab 20, which must extend slightly above the upper surface of the top.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A beverage can, comprising:

a bottom end, a top end, and a side wall extending therebetween;

a generally round first weakening score formed in the top end;

a generally round second weakening score formed on the side wall and adjacent the bottom end; a first tab having a first end extending over the first weakening score and a second end extending away from the first end, and is coupled to the can at a fulcrum positioned therebetween, the first tab being selectively displaceable between an initial position wherein the first tab is generally parallel to the can, and a displaced position wherein the first end pierces the can by causing the first weakening score to fail, thereby forming a first opening;

a second tab having a first end extending over the second weakening score and a second end extending away from the first end, and is coupled to the can at a fulcrum positioned therebetween, the second tab being selectively displaceable between an initial position wherein the second tab is generally parallel to the can, and a displaced position wherein the first end pierces the can by causing the second weakening score to fail, thereby forming a second opening;

wherein each of the first tab, the second tab and the can have distinct, respective longitudinal axes, and wherein, a plane containing the longitudinal axis of the can and the longitudinal axis of the first tab is generally orthogonal to a plane containing the longitudinal axis of the can and the longitudinal axis of the second tab, and wherein, beverage may exit the can from at least one of the first and second openings.

2. The beverage can as in claim 1, wherein the first end of the second tab extends toward the top end.

3. The beverage can as in claim 1, further comprising a flattened area; and, the second weakening score is positioned within the flattened area.

4. The beverage can as in claim 1, further comprising an edge formed where the side wall intersects the bottom end; and wherein, the second weakening score intersects the edge.

5. The beverage can as in claim 1, further comprising a depression formed on the can beneath the second end of the first tab.

6. The beverage can as in claim 1, further comprising a depression formed on the can beneath the second end of the second tab.

7. The beverage can as in claim 1, wherein the can is aluminum.

8. The beverage can as in claim 1, wherein the can is generally cylindrical.

9. A beverage can, comprising:

a bottom end, a top end, and a side wall extending therebetween;

a first weakening score formed in the top end;

a second weakening score formed adjacent the bottom end;

a first tab positioned adjacent the first weakening score and selectively displaceable to enable the first weakening score to fail and thereby form a first opening;

a second tab positioned adjacent the second weakening score and selectively displaceable to enable the second weakening score to fail and thereby form a second opening;

each of the first tab, the second tab, and the can have distinct respective longitudinal axes, and wherein, a plane containing the longitudinal axis of the can and the longitudinal axis of the first tab is generally orthogonal to a plane containing the longitudinal axis of the can and the longitudinal axis of the second tab, and wherein, as beverage exits the can from one of the first or second openings, the other opening provides a vent and enables expedited discharge of beverage from the can.

10. The beverage can as in claim 9, wherein the can is cylindrical.

11. The beverage can as in claim 9, the first tab having a first end extending over the first score and a second end distal its first end and a fulcrum positioned therebetween, the fulcrum coupling the first tab to the can and enabling the first tab to be selectively positioned between a first position wherein the first tab is generally parallel to the can, and a second position wherein the first end pierces the can by causing the first weakening score to fail, thereby forming the first opening.

12. The beverage can as in claim 9, the second tab having a first end extending over the second score and a second end distal its first end and a fulcrum positioned therebetween, the fulcrum enabling the second tab to be selectively positioned between a first position wherein the second tab is generally parallel to the can, and a second position wherein the first end pierces the can by causing the second weakening score to fail, thereby forming the second opening.

13. The beverage can as in claim 9, wherein the first tab comprises a first portion bound by the first weakening score, and a displaceable second portion attached thereto, and wherein, one may remove the first tab from the can by displacing the second portion until the first portion pulls away from the can at the first weakening score.

14. The beverage can as in claim 13, further comprising a depression on the can adjacent the second portion of the first tab.

15. The beverage can as in claim 9, wherein the second tab comprises a first portion bound by the second weakening score, and a displaceable second portion attached thereto, and wherein, the second tab is selectively removable from the can by displacing the second portion until the first portion pulls away from the can at the second weakening score.

16. The beverage can as in claim 15, further comprising a depression on the can adjacent the second end of the second tab.

17. The beverage can as in claim 9, wherein at least one of the tabs is removable from the can.

18. The beverage can as in claim 9, further comprising an edge formed where the bottom end intersects the side wall; and wherein, the second weakening score intersects the edge.

19. A beverage can, comprising:

a bottom end, a top end, and a side wall extending therebetween;

an edge formed where the bottom end intersects the side wall;

a generally round first weakening score formed in the top end;

a generally round second weakening score formed on the side wall and intersecting the edge;

a first tab having a first end extending over the first weakening score and a second end extending away from the first end, and is coupled to the can at a fulcrum positioned therebetween, the first tab being selectively displaceable between an initial position wherein the first tab is generally parallel to the can, and a displaced position wherein the first end pierces the can by causing the first weakening score to fail, thereby forming a first opening;

a second tab having a first end extending over the second weakening score and a second end extending toward the top end and away from the first end, the second tab being coupled to the can at a fulcrum positioned therebetween, and selectively displaceable between an initial position wherein the second tab is generally parallel to the can, and a displaced position wherein the first end pierces the can by causing the second weakening score to fail, thereby forming a second opening;

each of the first tab, the second tab, and the can have distinct respective longitudinal axes, and wherein, a plane containing the longitudinal axis of the can and the longitudinal axis of the first tab is generally orthogonal to a plane containing the longitudinal axis of the can and the longitudinal axis of the second tab;

and wherein, beverage may exit the can from at least one of the first and second openings.

* * * * *